United States Patent [19]

Siegman et al.

[11] 4,276,011

[45] Jun. 30, 1981

[54] SPINNERETTE ASSEMBLY

[75] Inventors: Edwin J. Siegman, Pensacola; Roy L. Yelverton, Gulf Breeze, both of Fla.

[73] Assignee: American Cyanamid Company, Stamford, Conn.

[21] Appl. No.: 13,345

[22] Filed: Feb. 21, 1979

[51] Int. Cl.[3] ..... A01J 17/00

[52] U.S. Cl. ..... 425/198; 264/176 F; 425/382.2; 425/464

[58] Field of Search ..... 425/378, 379, 198, 379 S, 425/382, 382.2, 464; 264/176 F

[56] References Cited

U.S. PATENT DOCUMENTS

| | | | |
|---|---|---|---|
| 2,408,713 | 10/1946 | Webb | 425/464 |
| 3,259,938 | 7/1966 | Martin | 425/464 |
| 3,299,472 | 1/1967 | Martin | 425/464 |
| 3,762,854 | 10/1973 | Kilsdonk | 425/464 |

FOREIGN PATENT DOCUMENTS

| | | | |
|---|---|---|---|
| 46-21313 | 6/1971 | Japan | 425/464 |
| 46-33122 | 9/1971 | Japan | 425/464 |

*Primary Examiner*—Jay H. Woo
*Attorney, Agent, or Firm*—Frank M. Van Riet

[57] ABSTRACT

A spinerette assembly wherein tapered passageways and distribution chambers of diminishing length are so arranged as to provide equal back pressure over all orifices thereby providing extrudates of improved uniformity of diameter after stretching.

5 Claims, 4 Drawing Figures

SPINNERETTE ASSEMBLY

This invention relates to a spinnerette assembly. More particularly, this invention relates to such an assembly wherein tapered passageways and distribution chambers of diminishing length are so arranged as to provide extrudates of a high degree of uniformity in diameter after stretching.

A spinnerette assembly is an apparatus through which hardenable material is extruded to form endless strands which become hardened subsequent to extrusion. A principal use for a spinnerette is in the production of fibers. A variety of such assemblies are available and they may differ widely depending upon the nature of the extrusion operation being conducted.

The material to be extruded is generally in fluid form and may be a pure polymer melt, a polymer solution, or a fusion melt comprising a polymer and a melt assistant therefore. Since these materials may contain solid particles of unmelted undissolved, or unfused polymers that would interfere with the continuity of the extrusion process, many spinnerette assemblies handling these types of compositions contain filtration units which remove such particles before they reach the orifices and thus avoid loss of continuity of individual orifices.

In providing spinnerette assemblies, it is desirable to provide a large plurality of orifices so that a large number of extrudates can emerge from a single spinnerette assembly and increase production rate thereof. Increased numbers of orifices, however, present additional problems in the extrusion process. Increasing the number of orifices increases the difficulties in maintaining uniform back-pressure over all of the orifices with the result that variation in the extrusion rates through the individual orifices will arise. In addition, wide variations in the diameters of the individual extrudates emerging from the equal diameter orifices will arise. Although much effort has been directed to overcoming the difficulties arising from extrusion using spinnerette assemblies containing large pluralities of orifices, these difficulties have not been satisfactorily overcome.

What is needed is a spinnerette assembly that provides uniform flow of extrusion material therethrough so as to equalize back-pressure of all orifices regardless of where the individual orifices are located and thereby provide extrudates of a high degree of consistency in diameters. Such a provision would fulfill a long-felt need and constitute a significant advance in the art.

In accordance with the present invention, there is provided a circular spinnerette assembly for extruding fluid hardenable material at substantially equal back pressure which comprises in combination a. A circular body member containing at the top in the central area thereof a conduit, at the bottom a spinnerette plate containing a plurality of orifices with counterbores, said orifices being arranged in concentric circular rows about the center of said circular body with the number of orifices in each row decreasing as the rows approach the center, and located within said circular body from top to bottom in the order named b. A first tapered passageway at the exit of said conduit decreasing in volume from the center to the outer periphery of said body.

c. collector means at the exit of said first passageway and at the outer periphery of said body, d. a second tapered passageway at the exit of said collector means which tapers towards the center of said body and communicates with e. a plurality of distribution chambers having lengths which decrease as their position within said body approaches the center of said body and which chambers communicate with the plurality of counterbores and orifices of said spinnerette plate.

In the preferred embodiments, filtration means interrupt the distribution chambers. In another preferred embodiment, means are provided to conduct heating medium through the spinnerette assembly.

The spinnerette assembly of the present invention provides extrudates at substantially equal back-pressure over all of the orifices regardless of where they are positioned in the spinnerette plate. The extrudates obtained are more consistent in stretched cross-sectional diameter or dimensions than those obtained from conventional spinnerette assemblies and this result is attributal to the uniformity of back-pressure across the orifices. The spinnerette assembly also leads to improved processability and greater productivity.

The spinnerette assembly is shown in the accompanying drawings in which

The spinnerette assembly of the present invention has a circular body member in which the various parts are located. The essential features of the spinnerette assembly are the tapered passageways, the decreasing distribution chamber lengths, and the initial inside-outside and subsequent outside-inside direction of passageways for hardenable material to flow therethrough, the combination of which provides a substantially constant back-pressure at the orifices regardless of their specific location.

Figure 1:
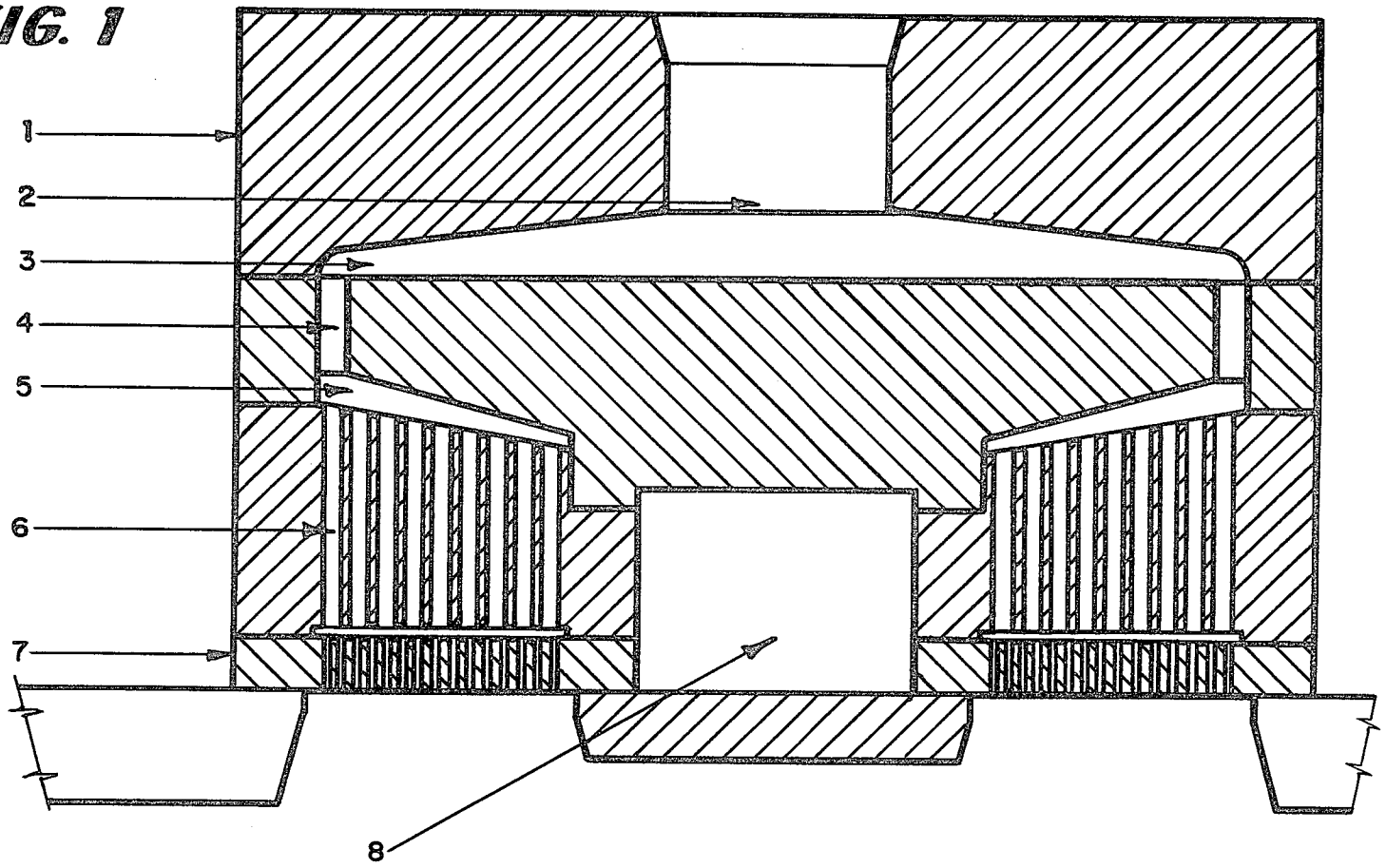
FIG. 1 represents a cross-sectional view of one preferred embodiment of the spinnerette assembly in annular form having heating means in the annulus.

In the embodiment shown in FIG. 1, the assembly is of annular design with a spinnerette plate 7 of circular rows of orifices and counterbores located at the bottom of the body member 1 and circling a centrally disposed reservoir 8 for receiving heat transfer medium. At the top of the body member is a centrally disposed conduit 2 for receiving hardenable extrusion material. The conduit communicates with a first tapered passageway 3 which narrows as it extends to the outer periphery of the body and conducts the extrusion material to a collector means 4 located at the outer periphery of the body. Communicating with the collector means is a second tapered passageway 5 which narrows as it approaches the center of the body and through which the extrusion material flows to the distribution chambers 6 which diminish in length as their positions approach the center of the body. These distribution chambers conduct extrusion material from the second passageway to the spinnerette plate.

Figure 2:
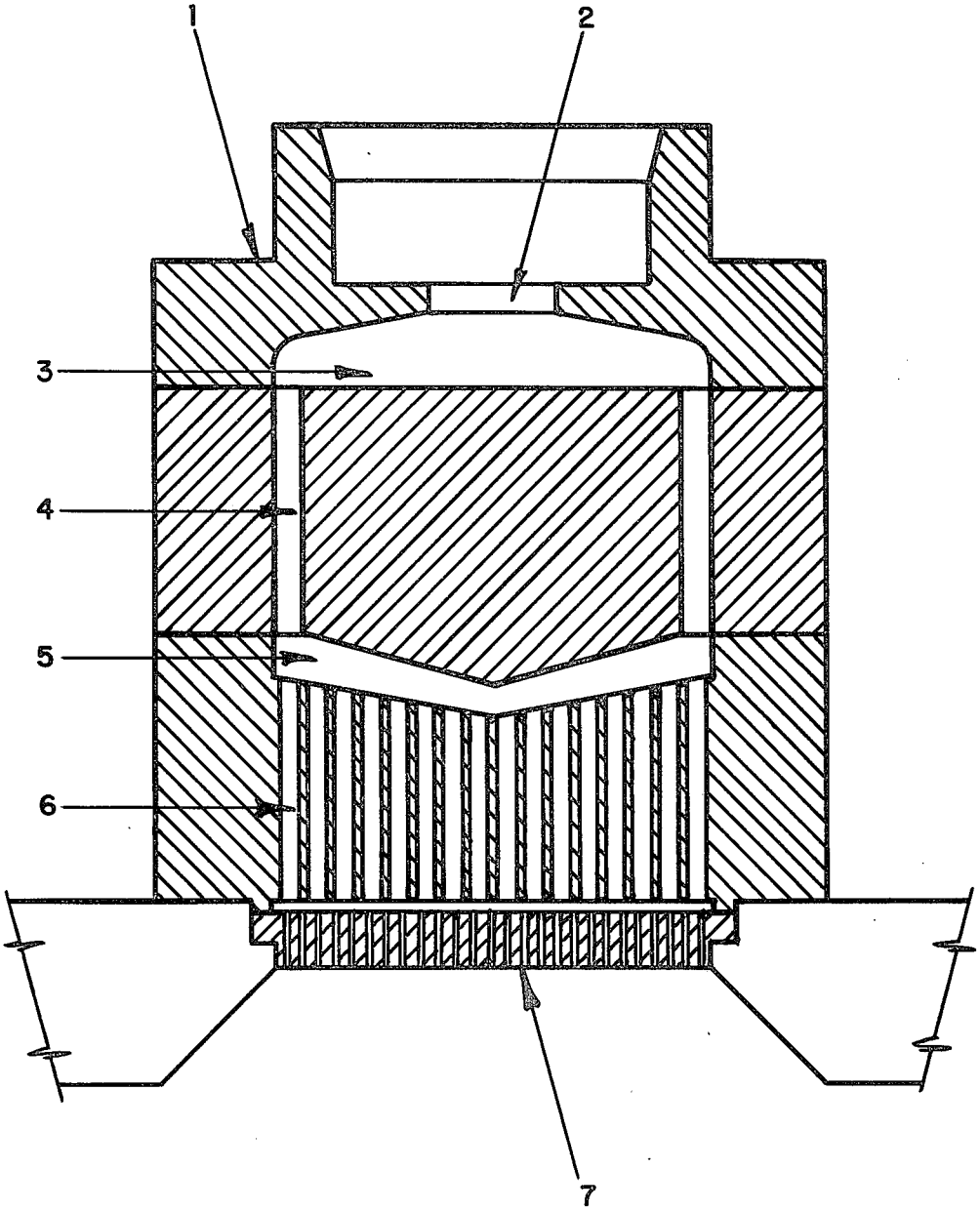
FIG. 2 represents a similar view of another embodiment of the spinnerette assembly wherein the center annulus is omitted.

In the embodiment shown in FIG. 2, the spinnerette assembly is of circular type and the reservoir 8, is omitted. The remaining parts have the same numbers and are as described with respect to FIG. 1.

Figure 3:
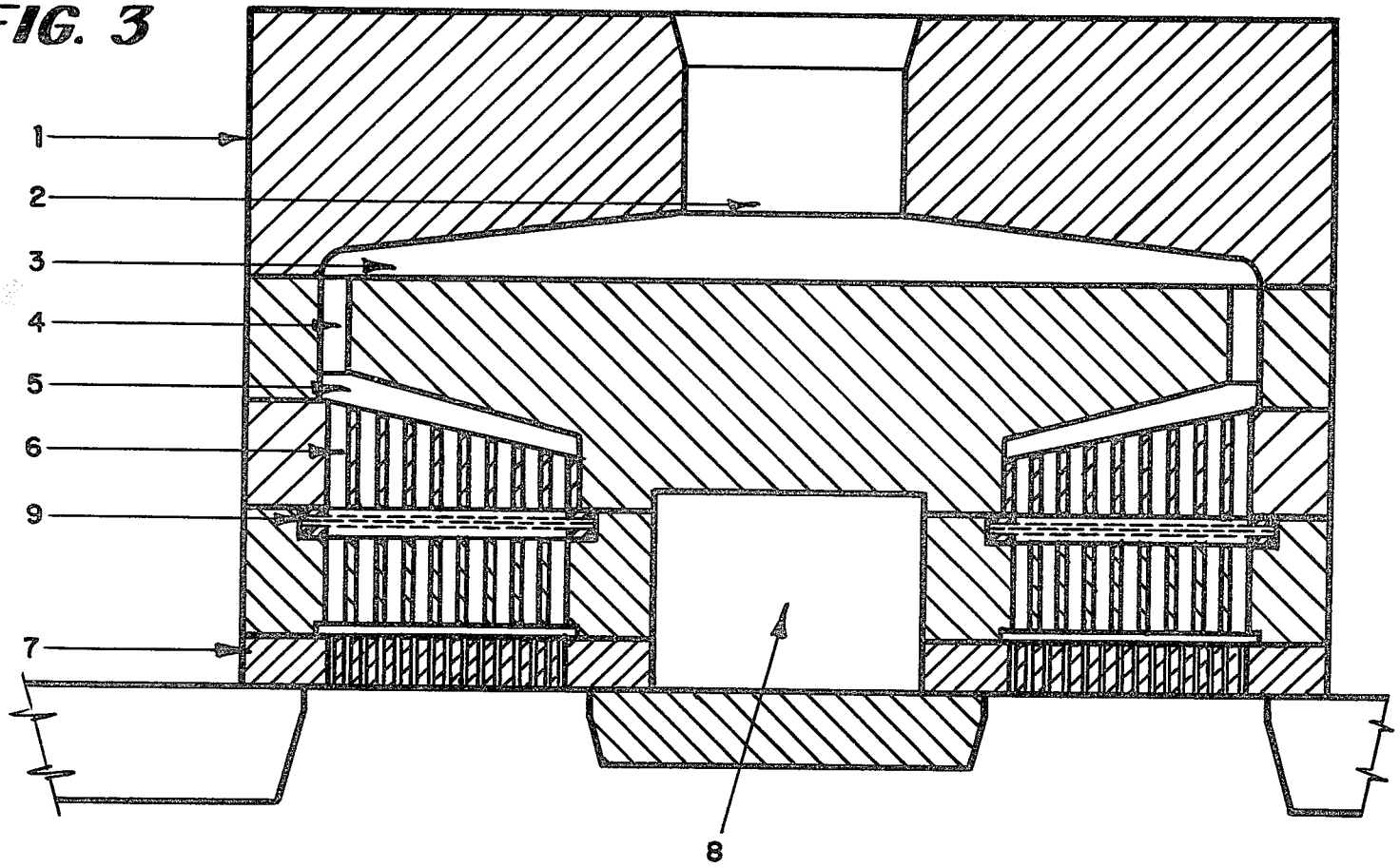
FIG. 3 represents a cross-sectional view of the spinnerette assembly of FIG. 1 having a filter means provided therein and FIG. 4 represents a similar view of the spinnerette assembly of FIG. 2 having a filter means provided therein.
Figure 4:
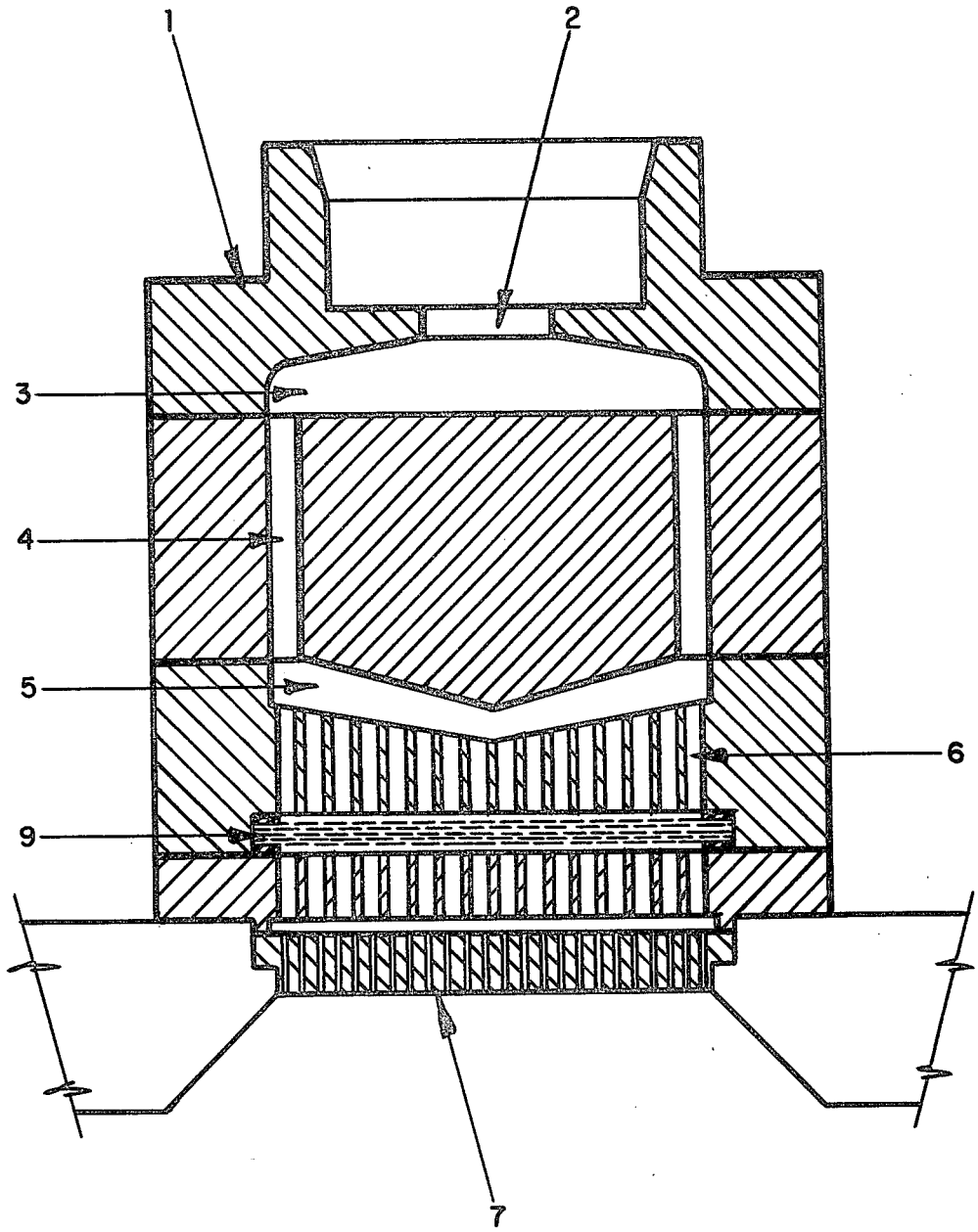

In the embodiment shown in FIG. 3, the embodiment of FIG. 2 is again shown except that a filtration means 9 is positioned across the path of the distribution chambers to remove impurities from the extrusion material.

In conducting extrusions using the spinnerette assembly of the present invention, fluid extrusion melt is forced into the conduit 2 of the circular body member 1 and enters the first tapered passageway 3 from whence it enters the collector means 4 at the outer periphery of the body. Means for providing heat (not shown) can be located outside the body to maintain or increase the temperature of the extrusion material as it passes through the collector means as well as at outer sites of the spinnerette assembly as may be desirable. From the collector means, the extrusion material passes through the second tapered passageway 5 from whence it travels to the distribution chambers. As the extrusion material passes through the distribution chamber it may be filtered if desired by the use of the filtration means 9. As the extrusion material leaves the distribution chambers it is forced by the extrusion pressure developed by an extruder (not shown) with or without an auxiliary pump through the counterbores and orifices of the spinnerette plate. In an annular design spinnerette assembly, additional heating of the extrusion material may be effected by suitable medium in reservoir 8. As is apparent from the routing of extrusion material through the spinnerette assembly, the extrusion material first flows from the inside (center) of the body to the outside thereof (outer periphery) and subsequently flows from the outside to the inside thereof.

The invention is more fully illustrated by the examples which follow.

EXAMPLE

In order to illustrate benefits of the spinnerette assembly of the present invention with respect to uniformity of fiber denier, the following procedure was conducted.

A polymer composition having an average composition of 84 weight percent polymer and 16 weight percent water was employed. The polymer composition was 11.5 weight percent methyl methacrylate and 88.5 weight percent acrylonitrile and its kinematic molecular weight value was 48,000. Kinematic molecular weight ($\overline{M}_k$) is obtained from the relationship $$\mu = 1/A\ \overline{M}_k$$

wherein $\mu$ is the average effluent time in seconds for a solution of 1 gram of the polymer in 100 milliliters of 53 weight percent aqueous sodium thiocynate at 40° C. multiplied by the viscometer factor and A is the solution factor derived from a polymer of known molecular weight. The resulting fusion melt provided by the extruder at autogenous pressure and suitable temperature was extruded through a spinnerette containing 3000 capillaries of 120 micron diameter having counterbores of 1.0 millimeter diameter at 175° C. at a linear velocity of fusion melt through the spinnerette of 10 meters per minute directly into a steam-pressurized solidification zone where the nascent filaments were adequately stretched to provide molecular orientation. The resulting fiber bundle was cross-sectioned and photomicrographs were taken to show the individual fiber round cross-sections. A representative number of individual filament diameters was measured, from which a mean value of cross-sectional area, standard deviation, and coefficient of variance (CV, %) were calculated. Results of this run provided a CV value of 15–18%.

COMPARATIVE EXAMPLE

Following the procedure of the Example in every material detail except for the spinnerette assembly, another run was made using a conventional spinnerette assembly using normal beaker plate type of distributors and straight throughput of extrusion material. Coefficient of variance of the filament diameters was determined as above and the value of CV obtained was 30–50% and greater.

We claim:

1. A circular spinnerette assembly for extruding hardenable fluid material at substantially equal back-pressure which comprises in combination a. a circular body member containing at the top in the central area thereof a conduit, at the bottom a spinnerette plate containing a plurality of orifices with counterbores, said orifices being arranged in concentric circular rows about the center of said circular body with the number of orifices in each row decreasing as the rows approach the center, and located within said circular body from top to bottom in the order named b. a first tapered passageway at the exit of said conduit decreasing in volume from the center to the outer periphery of said body, c. collector means at the exit of said first passageway and at the outer periphery of said body.

d. a second tapered passageway at the exit of said collector means which tapers towards the center of said body and communicates with e. a plurality of distribution chambers having lengths which decrease as their position within said body approaches the center of said body and which chambers communicate with the plurality of counterbores and orifices of said spinnerette plate.

2. The spinnerette assembly of claim 1 wherein filter means interrupt the distribution chambers.

3. The spinnerette assembly of claim 1 in annular form.

4. The spinnerette assembly of claim 3 wherein filter means interrupt the distribution chambers.

5. The spinnerette assembly of claim 3 wherein conducting means for heat transfer medium is provided in the annular area.

* * * * *